US005937915A

United States Patent [19]

Wahhoud

[11] Patent Number: 5,937,915

[45] Date of Patent: Aug. 17, 1999

[54] ON LOOM WEFT TEXTURIZING

[75] Inventor: Adnan Wahhoud, Lindau-Bodolz, Germany

[73] Assignee: Lindauer Dornier Gesellschaft mbH, Lindau, Germany

[21] Appl. No.: 08/991,064

[22] Filed: Dec. 15, 1997

[30] Foreign Application Priority Data

Dec. 19, 1996 [DE] Germany ..... 196 53 028

[51] Int. Cl.[6] ..... D03J 1/04; D03D 47/34

[52] U.S. Cl. ..... 139/450; 139/435.2

[58] Field of Search ..... 139/450, 435.2

[56] References Cited

U.S. PATENT DOCUMENTS

| | | | |
|---|---|---|---|
| 4,256,148 | 3/1981 | Scharling, II . | |
| 5,101,867 | 4/1992 | Sainen Tsutomo et al. | 139/435.2 |
| 5,295,516 | 3/1994 | Tanaka et al. | 139/435.2 |
| 5,323,982 | 6/1994 | Ligon et al. | 139/450 |

FOREIGN PATENT DOCUMENTS

| | | |
|---|---|---|
| 1499744 | 9/1967 | France . |
| 4222454 | 1/1993 | Germany . |

*Primary Examiner*—Andy Falik
*Attorney, Agent, or Firm*—W. F. Fasse; W. G. Fasse

[57] ABSTRACT

Filament threads such as rayon threads which may be smooth or partly texturized for protection, are texturized or entangled in the loom just prior to their insertion into a loom shed as weft threads. For this purpose a texturizer (4) is positioned between a filament thread supply spool (1) and a weft thread accumulator (3). The accumulator in turn is positioned just upstream of an air insertion nozzle (11) for injecting the weft threads into a loom shed. The texturizing is sufficient to lock the filaments into the filament thread body so that these texturized filaments form threads that can be pneumatically transported through the loom shed without causing so-called blow-outs of individual filaments out of the weft thread body.

11 Claims, 1 Drawing Sheet

ON LOOM WEFT TEXTURIZING

PRIORITY CLAIM

This application is based on and claims the priority under 35 U.S.C. §119 of German Patent Application 196 53 028.8, filed on Dec. 19, 1996. The entire disclosure of German Patent Application 196 53 028.8 is incorporated herein by reference.

FIELD OF THE INVENTION

The invention relates to the treatment of smooth or partly textured filament thread for use as weft threads in a pneumatic loom. The treatment in the form of entangling takes place between a filament thread supply spool and a weft accumulator roller while the loom is operating.

BACKGROUND INFORMATION

The use of smooth or partly textured weft yarns, particularly synthetic filament weft yarns in looms with a pneumatic weft insertion has posed a problem because these relatively smooth filament threads have a tendency to cause faulty weft insertions into a loom shed, especially into a pneumatic weaving loom in which the weft threads are transported through a weft insertion channel extending through the loom shed, by a main insertion nozzle and a plurality of relay nozzles. This problem is relatively small or nonexistent where such smooth or partially textured weft threads are used in a gripper loom or in a projectile weaving loom in which the transfer of the weft thread takes place mechanically. Thus, in such a mechanical transfer it is irrelevant whether the filament threads are completely partly or not at all texturized. However, it appears that a texturized thread is even preferred in gripper looms compared to smooth filament threads.

In connection with the use of synthetic filament weft yarns as weft threads in pneumatic looms, the degree of texturizing of the initially smooth yarns is of substantial importance because the thread surface characteristers determines the probability of faulty weft insertions. It is generally known that synthetic filament weft threads available on the market must be treated in a certain texturizing or entangling operation prior to using these threads in a pneumatic weft insertion loom in order to prevent individual filaments from popping out of the thread. However, conventional thread texturizing operations outside a loom achieve a weft thread texture that does not take into account the conditions that must be met for using such filament yarns in a pneumatic weft insertion loom. Practical experience has shown that conventional texturizing outside the loom results in yarns which do not meet ideal air insertion requirements because the texturizing does not take into account the conditions that must be satisfied when these yarns are to be used as weft threads in pneumatic weft insertion looms. For example, conventionally texturized weft threads are not contemuously texturizing along the entire thread length. Actually, conventionally texturized filament threads have only texturized points which are relatively widely spaced from one another along the length of the filament weft thread. The purpose of such texturized points is primarily to avoid an untwisting of the filaments in a filament thread such texturized points do not prevent individual filaments from becoming loose between texturized points.

Such conventionally texturized weft threads with widely spaced texturized points are only marginally or not at all suitable for use as weft threads in a pneumatic weft insertion loom because the formation of so-called blown-out weft threads that mar the fabric appearance and frequently require the removal of a blown-out thread cannot be avoided. By a blown-out thread is meant a weft thread that, due to the pneumatic insertion into the shed, has been untwisted at least partly by the weft insertion jets, whereby individual filaments pop out of the body of the filament thread. This blow-out takes place primarily when the main insertion jet or any of the relay jets impacts on the weft thread along a section outside a texturized point. Such thread sections can be relatively long between two texturized points in the same conventional filament weft thread. The term "texturizing" as used herein includes initial texturizing where the weft thread is smooth and further or post-texturizing where the weft thread is already provided with an initial texturizing.

OBJECTS OF THE INVENTION

In view of the above it is the aim of the invention to achieve the following objects singly or in combination:

to make smooth or partly textured filament threads ready for use as weft threads in a weaving loom by exposing these filament threads to a texturizing or at least to a post-texturizing treatment directly in a loom prior to the accumulation of these threads on a weft thread accumulator roller in the loom;

to perform the texturizing or post-texturizing treatment operation in response to the operational conditions of the weft thread accumulator; and to avoid in connection with the use of filament threads as weft threads in a pneumatic loom a so-called over-blowing or blow-out of filaments while simultaneously avoiding an excess application of a texturizing or post-texturizing treatment.

SUMMARY OF THE INVENTION

The above objects have been achieved according to the invention by applying a texturizing operation or treatment smooth or partially texturized filament threads when these threads travel from a filament thread supply spool to a weft thread accumulator roller, in a loom whereby the application of the texturizing treatment is so controlled that the filament threads become useable as weft threads in an air weaving loom. Preferably, the control is performed by feedback control signals signifying the withdrawal speed of the filament yarns from the filament supply spool. By sensing the withdrawal speed the respective signal signifies. According to the invention the present apparatus comprises a texturizing device positioned between a filament thread supply spool and a weft thread accumulator. The texturizing device or simply the texturizer applies a pneumatic pressure controlled fluid stream to the filament thread to bind the filaments into the thread body. For this purpose the texturizer is connected through a controllable pressure control valve to a source of fluid under pressure and the controllable valve is connected to a central loom control for controlling the valve and thus the fluid pressure in the texturizer in response to control values stored as a program in a memory of the loom control and/or in response to feedback control signals or values received from a sensor that monitors the current operational state of the weft thread accumulator. Both the texturizer and the weft accumulator are controllable by the loom control either in open loop fashion in response to a control program stored in a memory of the loom control and/or in closed loop fashion in response to sensed signal values representing the operational state of the weft accumulator that it operates or that it has stopped.

In a preferred embodiment the control of the texturizing or post-texturizing treatment depends on the withdrawal speed of the weft thread, whereby the texturizing is applied on a continuous basis, preferably a continuous but variable basis. More specifically, the continuous texturizing takes place only as long as the respective weft accumulator is operating and the texturizing is switched off when the respective accumulator stops. In connection with the use of a plurality of different weft threads for example different color and/or pretexturized weft threads, one or the other weft thread supply is temporarily switched off, the respective texturizer is also switched off in response to a signal signifying the respective off-state of the corresponding weft accumulator. To that extent, the texturizing is discontinuous.

According to the entire invention an adequate and uniform texturizing is applied along the length of a filament yarn, whereby the adequacy is determined by the requirement that the pneumatic weft insertion must not result in the above mentioned so-called over-blowing of the weft threads. This adequacy is assured if the jets that transport the weft thread through the weft insertion channel including the relay jets, impinge on a weft thread length that has been provided on its way to the weft accumulator with the required texture or entangling, whereby impinging on weft thread portions in which the filaments are not adequately locked into the thread is avoided.

BRIEF DESCRIPTION OF THE DRAWING

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
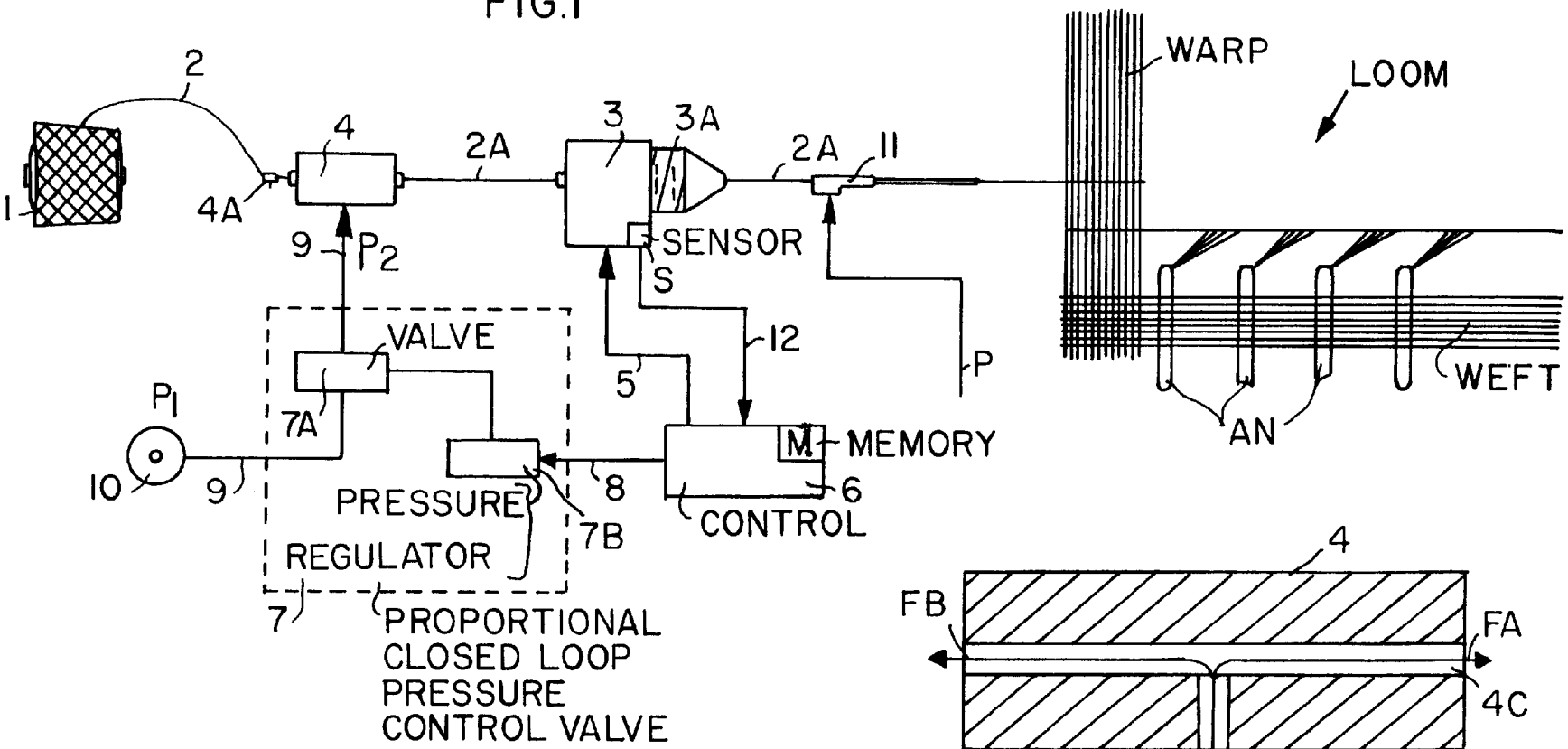
FIG. 1 shows the present apparatus illustrated in the form of a block diagram; as part of a pneumatic weft insertion loom

FIG. 1 shows a filament thread supply spool 1 for supplying filament thread 2 to a thread guide 4A which leads the filament thread 2 into a nozzle forming a texturizer 4. The texturizer 4 texturizes the filament thread 2 with a pressurized fluid flow to present a weft thread 2A at the exit of the texturizer 4. The sorted thread 2A is suitable for weft insertion in a pneumatic loom. For this purpose the filaments must be locked into the body of the filament thread so that individual filaments cannot stick out of the thread body. The texturized weft thread 2A is pulled onto a thread storage drum in a weft thread accumulator 3 provided with at least one sensor S. The weft thread accumulator 3 delivers the weft thread 2A to a main injection nozzle 11 which receives its fluid under pressure P from a pressure source 10 forming part of the loom. The nozzle 11 injects the weft thread into the loom shed formed by the warp threads and the auxiliary nozzles AN transport the weft thread through the weft insertion channel in the loom shed.

The weft accumulator 3, more specifically the drive motor of the accumulator, is electrically controllable through an electrical control conductor 5 connecting the motor of the accumulator 3 to the central loom control 6. The central loom control 6 has a memory M in which an operation program for the accumulator 3 and for the texturizer 4 are stored. Additionally, the central control 6 processes signal values received from the sensor S through a conductor 12. These signal values represent for example the operational state of the weft thread accumulator 3, the r.p.m. of the accumulator motor, and thus indirectly the withdrawal speed of the filament thread 2 from the spool 1, and similar values. A first control output conductor 8 of the control 6 is connected to a proportional closed loop pressure control valve 7 that includes a proportional valve member 7A and a pressure regulator 7B responsive in a closed loop fashion to a control signal from the control 6 through the control conductor 8. The valve member 7A is connected through a pressurized fluid line 9 to the pressure source 10 and to the inlet 4B of the texturizer 4. The pressure source 10 provides, for example a fluid under a pressure P1 while at the exit of the valve 7A the pressure is at a different pressure value P2 suitable for the tangling operation. The selection of the particular pressure will depend on the type of filament thread to be treated in the texturizer 4 for texturizing.

Figure 2:
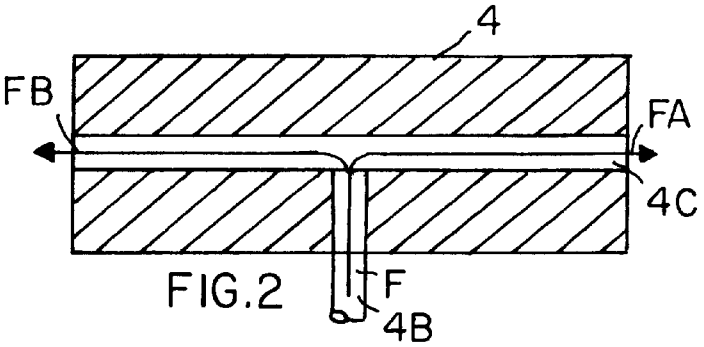
FIG. 2 is a sectional view through the filament texturizer in the form of a nozzle (4) shown in FIG. 1.

FIG. 2 shows the texturizer 4 in section. The texturizer 4 has a longitudinal bore 4C communicating with the inlet 4B so that a fluid flow F through the pressure line 9 enters into the bore 4C. The fluid flow F impinges on the bore wall opposite the inlet 4B in the bore 4C, whereby the flow is divided into two flow portions FA and FB exiting at opposite ends of the bore 4C. Each of the flow portions FA and FB may assume a spiral flow configuration during the travel from the center of the bore 4C to the exits thereof for texturizing and thereby locking the individual filaments into the body of the filament thread weft thread 2A.

In operation, a viscous filament yarn 2 for example of the weight characteristic 330 dtex (decigrams per one thousand meters) is stored on the coil or spool 1. It is assumed that this filament thread 2 does not have any texturizing yet. However, normally these viscous yarns have a so-called protection twist of about 70 to 90 turns per meter which may be referred to as pretexturizing. However, such protection twist does normally not provide the required closure or locking of the individual filaments into the thread necessary for pneumatic weft insertion. Thus, a so-called blow-out of a filament during a weft insertion by the main insertion nozzle 11 cannot be prevented. To avoid a blow-out, further or post-texturizing according to the invention is required to provide the texture for the weft threads required for faultless pneumatic weft insertion.

In operation the weft thread accumulator 3 is started by a signal from the control 6 through the control conductor 5 to cause the accumulator drum 3A to rotate. As a result, the filament yarn 2 is withdrawn from the spool 1 with a defined withdrawal speed that depends on the rotational speed of the drum 3A. Simultaneously with the starting of the accumulator 3, the closed loop control valve 7 is opened for providing the required fluid flow under pressure P2 into the inlet 4B in response to a control signal on the control conductor 8 from the control 6.

The pressure regulator 7B which conventionally is an integral part of the valve 7 makes sure that the pressure P2 supplied into the texturizer 4 is adjusted in response to the travel speed of the filament thread 2 through the texturizer 4 which in turn depends on the r.p.m. of the accumulator drum 3A in the accumulator 3. The pressure P2 may be smaller or larger than the pressure P1. The arrangement is such, that when a high withdrawal speed is applied to the filament thread 2, the pressure P2 at the inlet 4B of the texturizer 4 is automatically adjusted in closed loop fashion. If the loom operates in a so-called mixed weft insertion, namely the filament threads are supplied by two or more accumulators 3 in an alternating fashion, the fluid supply to the respective texturizer 4 will be stopped when the corresponding accumulator 3 is stopped either in accordance with a program stored in the memory M of the central loom control 6 or in response to a signal from the sensor S. Stated differently, the supply pressure P2 is also reduced to zero when the accumulator 3 stops. This feature has the advantage that the filament threads will not be over texturized. With the help of the sensor S the valve 7 can be controlled independently of any program to stop the supply of fluid under pressure in response to a signal signifying that the accumulator 3 has stopped for whatever reason. Such a signal will be supplied through the conductor 12 from the sensor S through the central control 6 to the valve 7 for a closed loop control of the texturizing in response to the weft thread withdrawal speed.

The texturizing will be considered to be sufficient as far as sections of threads are separated by smooth sections of threads if the auxiliary jets from the relay nozzles AN always encounter a texturized or post texturized portion of the filament weft threads. The invention is useful in connection with fully smooth filament threads and with filament threads having so-called protection twists at spaced intervals along the filament thread. The treatment providing such twists may be referred to as pre-texturizing.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method for texturizing a filament thread as weft thread in a loom with pneumatic weft insertion, said method comprising the following steps:

(a) withdrawing filament thread from a thread supply for weft insertion into a loom shed, (b) texturizing withdrawn filament thread to form a texturized weft thread whereby the filaments are a locked into the body of the filament thread, (c) winding said texturized weft thread onto a weft thread accumulator for intermediate storing said texturized weft thread on said weft thread accumulator in said loom, (d) sensing at least one control value from said weft thread for producing a control signal which represents a state of said weft thread accumulator and controlling in closed loop fashion said texturizing step (b) in response to said control signal, and (e) inserting said texturized weft thread with the filaments locked therein into a loom shed.

2. The method of claim 1, wherein said control value is produced by sensing a withdrawal speed of said weft thread from said thread supply, whereby said control signal signifies that said weft thread accumulator is in an operating state.

3. The method of claim 2, wherein said control value is produced by sensing a value representing a zero withdrawal speed thereby signifying that said weft thread accumulator is in a stopped state and stopping said texturizing step when said weft thread accumulator is stopped.

4. The method of claim 1, wherein said step of texturizing is performed continuously during said withdrawing step.

5. The method of claim 1, wherein said step of texturizing is performed intermittently during said withdrawing step.

6. The method of claim 1, wherein said step of texturizing is performed by applying a pressurized fluid flow to said filament thread whereby said controlling of said pressurized fluid flow is performed in said closed loop fashion.

7. The method of claim 1, wherein said pressurized fluid flow is a pneumatic flow.

8. The method of claim 1, wherein said weft accumulator is electrically controlled.

9. An apparatus for texturizing a filament thread to form a texturized weft thread (2A) in a loom with a pneumatic weft insertion, said apparatus comprising a filament thread supply spool (1), a weft thread accumulator (3) positioned downstream of said supply spool as viewed in a travel direction of said texturized weft thread toward said loom, a texturizing device (4) positioned between said supply spool (1) and said weft thread accumulator (3) for texturizing said filament thread (2) prior to winding said texturized weft thread (2A) onto said weft thread accumulator (3), a pressure source (10) for supplying a fluid under pressure to said texturizing device (4), a pressure line (9) connecting said pressure source (10) to said texturizing device (4), a control valve (7) in said pressure line, and a sensor (S) positioned for producing a control signal from said weft thread, said control signal representing a state of said weft thread accumulator (3), and a control (6) connected to said sensor (S) and to said control valve (7) for controlling in closed loop fashion a supply of fluid under pressure to said texturizing device (4).

10. The apparatus of claim 9, wherein said control valve is a proportional closed loop pressure control valve (7).

11. The apparatus of claim 9, wherein said sensor (S) is positioned in said weft thread accumulator for sensing control values representing said state of said weft thread accumulator (3), said apparatus further comprising an electrical conductor (12) connecting said control (6) to said sensor (S), and a further electrical conductor (8) connecting a control output of said control (6) to said control valve (7) for said controlling in said closed loop fashion.

* * * * *

UNITED STATES PATENT AND TRADEMARK OFFICE

CERTIFICATE OF CORRECTION

PATENT NO. : 5,937,915

DATED : Aug. 17, 1999

INVENTOR(S) : Wahhoud

It is certified that error appears in the above-identified patent and that said Letters Patent is hereby corrected as shown below:

Col. 1, line 33, after "completely", insert --,--;
line 40, after "surface ", replace "characteristers", by --characteristic--;
line 56, after "not", replace "contemuously" by --continuously--;
line 57, before "along", replace "texturizing" by --texturized--;

Col. 2, line 27, before "in", delete "operation";
line 38, after "treatment", insert --to--;
line 41, after "roller", delete ","; after "loom", insert --,--;
line 47, after "signifies", insert the following:
--the operational state of a weft thread accumulator. When the withdrawal speed becomes zero it means the accumulator has stopped.--.

Col. 3, line 15, after "the", delete "entire";
line 16, after "the", insert --entire--;
line 24, before ",", delete "or entangling";
line 34, after "diagram", delete ";";
line 35, after "loom", insert --;--;
line 47, after "The", replace "sorted" by --so treated--;

Col. 4, line 41, before "further", insert --a--;
line 42, before "faultless", insert --a--.

Signed and Sealed this

Twenty-ninth Day of February, 2000

*Attest:*

Q. TODD DICKINSON

*Attesting Officer*

*Commissioner of Patents and Trademarks*